US009069277B2

(12) United States Patent
Suzuki et al.

(10) Patent No.: US 9,069,277 B2
(45) Date of Patent: Jun. 30, 2015

(54) IMAGE FORMING APPARATUS INCLUDING A CONTROLLER CONFIGURED TO SWITCH A STATE OF DEVELOPING ROLLER BETWEEN A STOPPED STATE AND A ROTATING STATE

(75) Inventors: Yasuhiro Suzuki, Nagoya (JP); Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 177 days.

(21) Appl. No.: 13/338,758

(22) Filed: Dec. 28, 2011

(65) Prior Publication Data

US 2012/0163871 A1 Jun. 28, 2012

(30) Foreign Application Priority Data

Dec. 28, 2010 (JP) ..... 2010-293222

(51) Int. Cl.
*G03G 15/01* (2006.01)

(52) U.S. Cl.
CPC .... *G03G 15/0136* (2013.01); *G03G 2215/0119* (2013.01); *G03G 2215/0103* (2013.01); *G03G 2215/0122* (2013.01); *G03G 15/0189* (2013.01)

(58) Field of Classification Search
CPC ..... G03G 2215/0103; G03G 2215/0122; G03G 2215/0119
USPC ..... 399/228, 53–66
See application file for complete search history.

(56) References Cited

U.S. PATENT DOCUMENTS

| | | | | |
|---|---|---|---|---|
| 6,643,484 | B2 | 11/2003 | Kojima et al. | |
| 7,792,464 | B2 | 9/2010 | Okabe et al. | |
| 2002/0003968 | A1 * | 1/2002 | Maruyama | 399/67 |
| 2002/0118981 | A1 | 8/2002 | Kojima et al. | |
| 2003/0138270 | A1 * | 7/2003 | Matsuoka | 399/228 |
| 2004/0228648 | A1 * | 11/2004 | Yanagida et al. | 399/100 |
| 2007/0077093 | A1 | 4/2007 | Okabe et al. | |
| 2010/0290813 | A1 | 11/2010 | Okabe et al. | |
| 2012/0243910 | A1 * | 9/2012 | Aratachi et al. | 399/236 |

FOREIGN PATENT DOCUMENTS

| | | | |
|---|---|---|---|
| JP | 2002006579 A | * | 1/2002 |
| JP | 2002023451 A | * | 1/2002 |
| JP | 2002258571 A | | 9/2002 |
| JP | 2005157145 A | * | 6/2005 |
| JP | 2007101636 A | | 4/2007 |

* cited by examiner

*Primary Examiner* — David Gray
*Assistant Examiner* — Tyler Hardman
(74) *Attorney, Agent, or Firm* — Banner & Witcoff, Ltd.

(57) ABSTRACT

An image forming apparatus may include controls for changing a state of a developing roller from a stopped state to a rotating state. The change in state may be used to avoid deterioration of toner and/or a surface of the developing roller. Changes in state may occur at various times including at a timing corresponding to an outside of an image formation area, a timing corresponding to an inside of an image formation area and the like. In one arrangement, a first developing roller may continue to rotate (e.g., during monochrome printing), while one or more other developing rollers are switched between a stopped state and a rotating state. Alternatively or additionally, a roller which is caused to change states may remain stopped between the timing corresponding to a rear end of an image formation area and a timing corresponding to a front end of an immediately subsequent image formation area.

17 Claims, 6 Drawing Sheets

IMAGE FORMING APPARATUS INCLUDING A CONTROLLER CONFIGURED TO SWITCH A STATE OF DEVELOPING ROLLER BETWEEN A STOPPED STATE AND A ROTATING STATE

CROSS REFERENCE TO RELATED APPLICATION

This application claims priority from Japanese Patent Application No. 2010-293222, filed on Dec. 28, 2010, the entire subject matter and contents of which are incorporated herein by reference.

TECHNICAL FIELD

Aspects of the disclosure relate to an image forming apparatus capable of executing both monochrome printing and color printing.

BACKGROUND

Some existing electrophotographic color image forming apparatuses may include photosensitive drums and developing devices in the same number as colors of toner. Each of the photosensitive drums is configured to carry an electrostatic latent image thereon. Each of the developing devices includes a developing roller configured to rotate in contact with (either directly or indirectly with toner therebetween) a corresponding one of the photosensitive drums and supply toner to the electrostatic latent image thereon. The image forming apparatus may further include a transfer belt disposed facing the photosensitive drums. Toner images formed on the respective photosensitive drums are sequentially transferred onto a sheet of paper fed on the transfer belt.

Existing color image forming apparatuses may be configured such that all photosensitive drums rotate in contact with the transfer belt not only in color printing but also in monochrome printing. In this configuration, when the developing rollers rotate in accordance with rotation of the photosensitive drums, toner particles may rub against each other, resulting in toner deterioration. To prevent toner deterioration, an image forming apparatus may stop the developing rollers, except for the developing roller for black, in monochrome printing. However, when all photosensitive drums are still rotating in monochrome printing, toner between the photosensitive drums and the developing rollers, except for black, deteriorates and vanishes, and a strong friction is produced therebetween. As a result, in colors except for black, the developing rollers may be shaved locally (e.g., a surface or portion of the developing rollers may deteriorate) due to the continued rotation of photosensitive drums while the developing rollers are stopped.

To prevent the developing rollers from being shaved locally, a known image forming apparatus includes a separation mechanism configured to separate the photosensitive drums and the developing rollers for colors except for black. The separation mechanism includes separation members and gears to move the developing devices. In color printing, the separation mechanism is configured to bring all developing rollers in contact with the respective photosensitive drums (either directly or indirectly with toner therebetween). In monochrome printing, the separation mechanism is configured to bring only the developing roller for black in contact with the corresponding photosensitive drum and to separate the developing rollers for the other colors from the corresponding photosensitive drums.

Through the provision of the separation mechanism, the photosensitive drums and the respective driving rollers except for black do not rub against each other in monochrome printing. Thus, the wearing away of the developing rollers and toner deterioration can be reduced.

However, in the above described image forming apparatus, the separation mechanism may involve inclusion of many components and thus may be complicated in structure and/or costly.

SUMMARY

Aspects of the present disclosure may provide an image forming apparatus which is configured to reduce a potential for deterioration of toner and wearing of developing rollers resulting from rubbing of photosensitive drums and the developing rollers. In one example, an image forming apparatus may be configured to reduce the potential for deterioration of toner and wearing of developing rollers without having to provide a separation mechanism that separates the photosensitive drums and the developing rollers from each other.

According to an aspect of the disclosure, an image forming apparatus may include one or more photosensitive members, one or more corresponding developing rollers and a controller. The controller may be configured to switch a developing roller, during a continuous rotation of another developing roller, between a first state where the developing roller stops (e.g., does not rotate) with a corresponding photosensitive member contacting developer supplied by the developing roller and a second state where the developing roller rotates with the corresponding photosensitive member contacting the developer supplied by the developing roller.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative first embodiment of the disclosure will be described in detail with reference to the accompanying drawings. An image forming apparatus according to illustrative aspects of the disclosure is applied to a color printer 1.

The general structure of the color printer 1 will be described with reference to FIG. 1.

For ease of discussion, in the following description, the top or upper side, the bottom or lower side, the left or left side, the right or right side, the front or front side, and the rear or rear side are used to define the various parts when the color printer 1 is disposed in an orientation in which it is intended to be used and operated. In FIG. 1, the left side is referred to as the front or front side, the right side is referred to as the rear or the rear side, the up side is referred to as the top or upper side, and the down side is referred to as the bottom or lower side.

Figure 1:
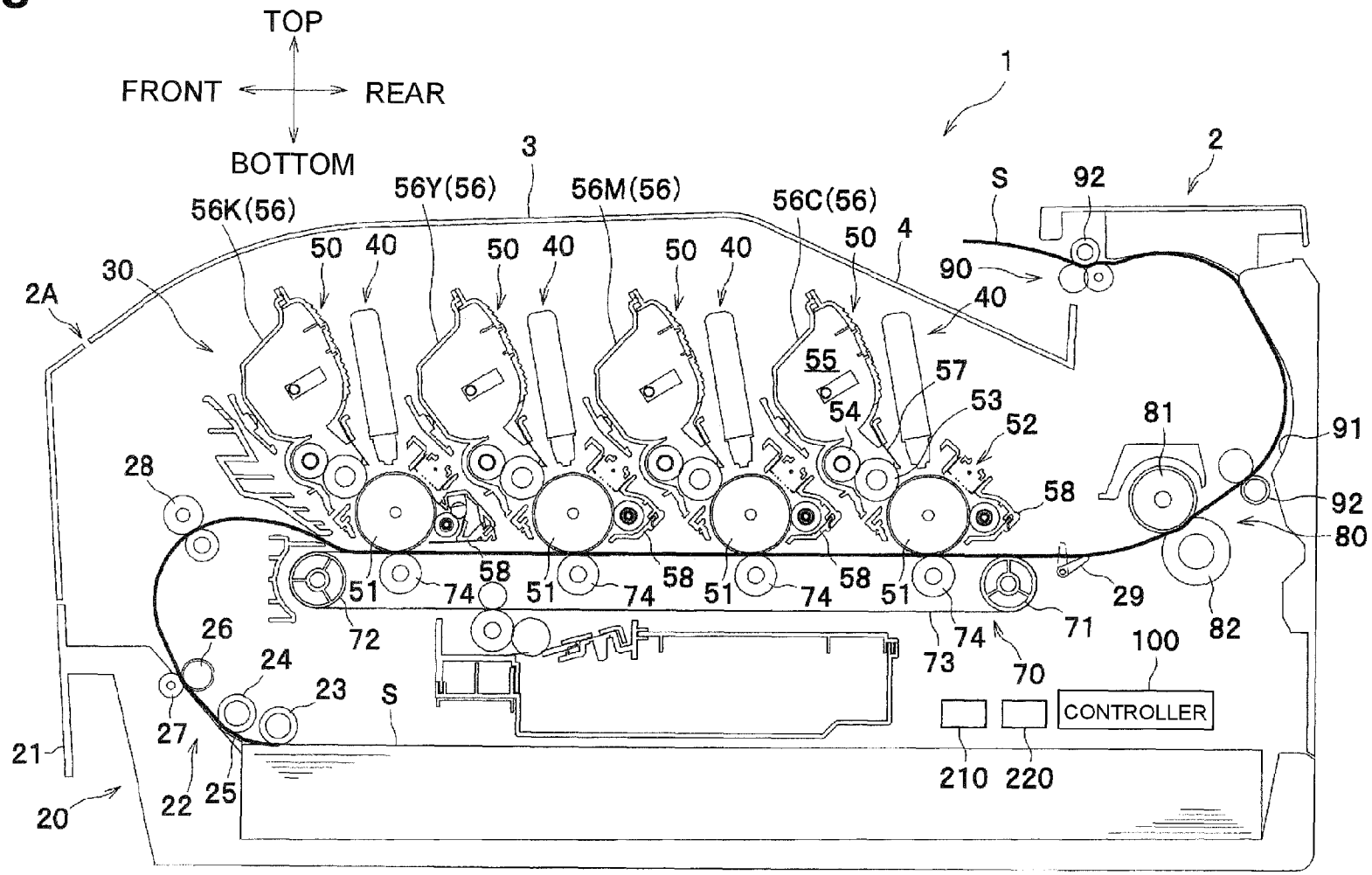
FIG. 1 is a cross sectional view of an example laser printer according to a first embodiment of the disclosure.

As shown in FIG. 1, the color printer 1 includes, in a main body, a sheet supply unit 20, an image forming unit 30, a sheet ejection unit 90, and a controller 100. The sheet supply unit 20 is configured to supply a transfer medium, e.g., a sheet S, to the image forming unit 30. The image forming unit 30 is configured to form an image on the sheet S. The sheet ejection unit 90 is configured to eject the sheet S having the image to an ejection tray 4.

The main body 2 has an opening 2A in an upper portion. The opening 2A is opened and closed by an upper cover 3 pivotally supported by the main body 2. An upper surface of the upper cover 3 contains the ejection tray 4 configured to receive sheets S ejected from the main body 2 such that the sheets S are overlaid one on top of another in a stacked relationship.

The sheet supply unit 20 is disposed in a lower portion in the main body 2, and includes a sheet supply tray 21 configured to be attached to or removed from the main body 2 and a sheet supply mechanism 22 configured to feed a sheet S from the sheet supply tray 21 to the image forming unit 30. The sheet supply mechanism 22 is disposed in a front portion of the sheet supply tray 21, and includes a pickup roller 23, a separation roller 24, and a separation pad 25, which are configured to separate a single sheet S from the sheet supply tray 21.

In the sheet supply unit 20, a sheet S is singly picked up from the sheet supply tray 21 and fed upward. When the sheet S passes between a paper dust removing roller 26 and a pinch roller 27, paper dust is removed from the sheet S. The sheet S is fed rearward, and passes between a pair of registration rollers 28. The registration rollers 28 are configured to stop the sheet S when contacting a leading end of the sheet S in order to correct skewing of the sheet S before entering the image forming unit 30 and adjust a time at which an image is formed. After being adjusted by the registration rollers 28, the sheet S is supplied to the image forming unit 30.

The image forming unit 30 includes multiple, e.g., four, LED units 40, four process cartridges 50, a transfer unit 70, and a fixing unit 80.

The LED units 40 are pivotally coupled to an LED attaching member, which is not shown and disposed in a lower portion of the upper cover 3. The LED units 40 are positioned by a positioning member, which is not shown and disposed in the main body 2.

The process cartridges 50 are disposed between the upper cover 3 and the sheet supply unit 20 and arranged in line in the front-rear direction. Each of the process cartridges 50 includes a drum cartridge 58 and a developing cartridge 56 configured to be attached to and removed from the drum cartridge 58.

Each developing cartridge 56 includes a developing roller 53, a supply roller 54, a layer thickness regulating blade 57, and a toner chamber 55 configured to store toner, as an example of a developer. In this embodiment, non-magnetic single component toners are used.

Developing cartridges 56 are a developing cartridge 56K storing black toner, a developing cartridge 56Y storing yellow toner, a developing cartridge 56M storing magenta toner, and a developing cartridge 56C storing cyan toner, which are arranged in this order from an upstream side in a sheet feed direction where the sheet S is fed.

Each drum cartridge 58 includes a photosensitive drum 51, as an example of a photosensitive member, and a scorotron charger 52. In this disclosure, when the photosensitive drums 51 and the developing rollers 53 are specified with a color of toner, the numerals may be affixed with K, Y, M and C.

In this disclosure, the photosensitive drum 51K corresponding to black toner is also referred to as a first photosensitive drum 51K, as an example of a first photosensitive member, and the photosensitive drums 51Y, 51M and 51C corresponding to toner of the other colors except for black are also referred to as second photosensitive drums 51Y, 51M and 51C, as examples of a second photosensitive member. Similarly, the developing roller 53K for black toner that is configured to rotate and supply black toner to a contact position where the first photosensitive drum 51K contacts the black toner is referred to as a first developing roller 53K, and the developing rollers 53Y, 53M, and 53C for toner of the other colors except for black that are configured to rotate and supply yellow toner, magenta toner, and cyan toner to a contact position where each of the second photosensitive drums 51Y, 51M and 51C contacts corresponding toner are referred to as second developing rollers 53Y, 53M, and 53C. According to one or more aspects, the terms first photosensitive member, first developing roller, second developing roller and second photosensitive member may be used to designate different combinations of photosensitive members and rollers. For example, the first photosensitive member may correspond to photosensitive drum 51M, and the first developing roller may correspond to developing roller 53M, while the second photosensitive member may correspond one or more of the other drums 51Y, 51K and 51C and the second developing roller may refer to one or more of the other rollers 53Y, 53K and 53C.

The first developing roller 53K is driven by a first drive source 210, which is disposed in the main body 2 and controlled by a controller 100. The second developing rollers 53Y, 53M, and 53C are driven by a second drive source 220 disposed in the main body 2 and controlled by the controller 100 such that the second developing rollers 53Y, 53M, and 53C simultaneously rotate and stop.

The transfer unit 70 is disposed between the sheet supply unit 20 and each process cartridge 50. The transfer unit 70 includes a drive roller 71, a driven roller 72, a belt 73, and a plurality of, e.g., four, transfer rollers 74. The transfer unit 70 includes, in this example arrangement, both belt units that convey sheets S and belt units that convey toner images to sheet S. In the following description, the transfer unit 70 is configured to convey sheets S.

The drive roller 71 and the driven roller 72 are spaced apart from each other in the front-rear direction and disposed horizontally. The belt 73 is an endless belt and extends between the drive roller 71 and the driven roller 72. The belt 73 is disposed such that its upper outer surface contacts the photosensitive drums 51. The transfer rollers 74 are disposed inside the belt 73 such that the transfer rollers 74 and the photosensitive drums 51 sandwich the belt 73 therebetween. The transfer rollers 74 are configured to be subjected to a transfer bias (voltage) having a polarity opposite to a toner charge polarity under constant current control during image transfer.

The fixing unit 80 is disposed behind the process cartridges 50 and the transfer unit 70. The fixing unit 80 includes a heat roller 81 and a pressure roller 82, which is disposed facing the heat roller 81 and configured to press the heat roller 81.

In the image forming unit 30 structure described above, in a color printing mode, the surfaces of the photosensitive drums 51 are uniformly charged by the respective scorotron chargers 52, and exposed by the respective LED units 40 such that electrostatic latent images are formed, based on image data, in exposed areas of the surfaces whose potential is lowered.

In each process cartridge 50, toner in the toner chamber 55 is supplied via the supply roller 54 to the developing roller 53. When toner is supplied to the developing roller 53, toner is regulated by the layer-thickness regulating blade 57, and is carried on the developing roller 53 as a thin layer having a uniform thickness. Toner in the toner chamber 55 is agitated by an agitator, not shown, when the developing roller 53 rotates. Toner carried on the developing roller 53 is supplied to the electrostatic latent image formed on the photosensitive drum 51 when the developing roller 53 rotates in contact with the photosensitive drum 53 (directly or indirectly with toner sandwiched or pressed therebetween). Thus, the electrostatic latent image is developed with toner to form a visible toner image on the photosensitive drum 51.

When a sheet S supplied onto the belt 73 passes in between the photosensitive drums 51 and the belt 73, which is sandwiched between the photosensitive drums 51 and the transfer rollers 74, the toner images formed on the surfaces of the photosensitive drums 51 are transferred and overlaid one over the other on the sheet S. When the sheet S further passes in between the heat roller 81 and the pressure roller 82, the toner images are thermally fixed onto the sheet S.

The ejection unit 90 includes a guiding portion 91 and a plurality of, e.g., two, pairs of feed rollers 92. The guiding portion 91 extends upward from an outlet of the fixing unit 80 and bends frontward to define a sheet ejection path. The feed rollers 92 feed the sheet S on which the toner images are transferred and thermally fixed in the sheet ejection path and eject the sheet S to the ejection tray 4 outside of the main body 2.

The controller 100 will be described in further detail.

The controller 100 includes a central processing unit (CPU), a read-only memory (ROM), a random access memory (RAM), and is configured to execute print data reception and to control the sheet supply unit 20, the image forming unit 20 and the ejection unit 90 in accordance with prepared programs including computer readable and executable instructions. Specifically, the controller 100 is configured to provide a monochrome printing mode to form an image on a sheet S using the first photosensitive drum 51K and a color printing mode to form an image on a sheet S using the first and second photosensitive drums 51K, 51Y, 51M, and 51C.

The controller 100 controls the registration rollers 28, the first drive source 210 and the second drive source 220 as appropriate. In the monochrome printing mode, the controller 100 executes specified controls described below. The controller 100 is configured to receive a signal inputted from a sheet sensor 29 and detect a sheet S passes through the sheet sensor 29. The sheet sensor 29 has a known structure, and is disposed downstream from the photosensitive drum 51C for cyan.

The following will describe controls of the controller 100 when executing continuous printing in the monochrome printing mode.

In this disclosure, "continuous printing in the monochrome printing mode" includes a case in which a print instruction indicating multiple pages to be printed in monochrome is inputted to the controller 100 and a case in which a print instruction indicating one page to be printed in monochrome is intermittently inputted to the controller 100 in a short period of time. A print job for multiple pages or print jobs for multiple pages are spooled and monochrome printing is continuously executed until printing of the multiple pages spooled is completed.

In the continuous printing in the monochrome printing mode, the controller 100 is configured to feed sheets S at a short interval in ordinary cases and at a longer interval when the number of sheets S printed consecutively and/or continuously exceeds a specified value. At the short interval, the distance between sheets S to be fed is separated by about a quarter length of an upper flat surface of the belt 43 (e.g., an interval shown in FIG. 5A). At the longer interval, sheets S to be fed are separated by the entire length of the upper flat surface of the belt 43 or a slightly longer length (e.g., an interval shown in FIG. 2B). When the number of sheets S printed consecutively and/or continuously exceeds the specified value, and when the sheet sensor 29 detects (or in response to the sheet sensor 29 detecting) that a trailing end of a sheet S has passed the sensor 29, the controller 100 controls the second drive source 220 so as to switch the state of one or more of the second developing rollers 53Y, 53M and 53C from a first state (stopped state) to a second state (rotating state) such that the second driving rollers 53Y, 53M and 53C are temporarily rotated and stopped (e.g., returned to the first state). In some cases, the states of all of the second developing rollers 53Y, 53M and 53C may be switched. At this time a temporary rotation amount of the second developing rollers 53Y, 53M and 53C is set to be smaller than one rotation of the second developing rollers 53Y, 53M and 53C.

Operations in the monochrome printing mode by the controller 100 structured above will be described with reference to FIGS. 2A and 2B.

According to one or more arrangements, every time the sheet supply unit 20 supplies a sheet S from the sheet supply tray 21, the controller 100 temporarily stops the registration rollers 28 to cause a leading end of the sheet S to contact the registration rollers 28. The controller 100 causes the registration rollers 28 to rotate at such a timing and speed so as to feed sheets S at the interval described above, such that the sheet S is supplied and fed to the belt 73 as shown in FIG. 2A. At this time, all photosensitive drums 51 rotate in contact with the belt 73 as the belt 73 rotationally moves. In the monochrome printing mode, the process cartridge 50 for black and the corresponding transfer roller 74 are operated to transfer toner onto the sheet S. During toner image transfer onto the sheet S, the controller 100 controls the first drive source 210 to cause the first developing roller 53K to rotate in contact with the first photosensitive drum 51K (either directly contacting or indirectly contacting with toner pressed therebetween), and controls the second drive source 220 to cause the second developing rollers 53Y, 53M and 53C to stop rotating. In this state, toner is not agitated in each of the developing cartridges 56Y, 56M, and 56C including the developing rollers 53Y, 53M and 53C, respectively, and thus deterioration of toner can be reduced.

When the number of sheets S continuously and/or consecutively printed exceeds a specified value, the controller 100 controls the second drive source 220, when detecting that a trailing end of a sheet S, printed immediately before a present sheet, just finished printing, to switch the state of the second developing rollers 53Y, 53M and 53C from the stopped state to the rotating state such that the second developing rollers 53Y, 53M and 53C rotate temporarily.

When a specified time corresponding to an amount of the temporary rotation has elapsed since the second developing rollers 53Y, 53M, and 53C started to rotate, the controller 100 controls the second drive source 220 to switch the state of the second developing rollers 53Y, 53M, and 53C from the rotating state to the stopped state such that they stop rotating. The controller 100 then controls the registration rollers 28 to re-start feeding of the sheet S.

In the color printer 1 according to the first embodiment, the above operation can reduce deterioration of both of toner and the second developing rollers 53Y, 53M, and 53C. While the second developing rollers 53Y, 53M, and 53C are brought to a standstill in the monochrome printing mode as described above, deterioration of toner can be reduced. However, if the monochrome printing continues for a long time with the second developing rollers 53Y, 53M, and 53C remaining in the stopped state, the second photosensitive drums 51Y, 51M and 51C continue rotating, and rubbing against the second developing rollers 53Y, 53M, and 53C in contact positions where the second photosensitive drums 51Y, 51M and 51C contact toner on the second developing rollers 53Y, 53M, and 53C. Thus, toner is gradually consumed by the rubbing at the contact positions. When almost no toner remains in the contact positions between each of the second photosensitive drums 51Y, 51M and 51C and a corresponding one of the second developing rollers 53Y, 53M, and 53C, the friction therebetween increases, which may result in damage to the surfaces of the second developing rollers 53Y, 53M, and 53C.

Using the methods and systems described with respect to the first embodiment, when the number of sheets S consecutively and/or continuously printed exceeds the specified value, the second developing rollers 53Y, 53M, and 53C are brought to rotate temporarily in order to slightly change the contact positions where each of the second photosensitive drums 51Y, 51M and 51C contacts toner on a corresponding one of the second developing rollers 53Y, 53M, and 53C. Accordingly, toner is supplied to contact positions between each of the second photosensitive drums 51Y, 51M and 51C and a corresponding one of the second developing rollers 53Y, 53M, and 53C. In one example of the first embodiment, toner is interposed between each of the second photosensitive drums 51Y, 51M and 51C and a corresponding one of the second developing rollers 53Y, 53M, and 53C. Thus, the wearing away of the surfaces of the second developing rollers 53Y, 53M, and 53C, due to direct rubbing between each of the second photosensitive drums 51Y, 51M and 51C and a corresponding one of the second developing rollers 53Y, 53M, and 53C, may be reduced.

In the first embodiment, a switchover of the second developing rollers 53Y, 53M, and 53C from the stopped state to the rotating state and a switchover of the second developing rollers 53Y, 53M, and 53C from the rotating state to the stopped state are performed at a timing corresponding to an outside of an image formation area. In other words, the timing corresponding to the outside of the image formation area in the first embodiment may be a timing when contact points where the second developing rollers 53Y, 53M, and 53C contact the second photosensitive drums 51Y, 51M and 51C correspond to an outside of an image formation area. Thus, vibrations from the second photosensitive drums 51Y, 51M and 51C due to the switching operation do not affect image formation.

In some examples of this disclosure, "the image formation area" refers to an area in which an image is formed on the sheet S. For example, as to the second developing roller 53Y, "the timing corresponding to the outside of the image formation area" may refer to a predetermined amount of time before a time at which the photosensitive drum 51Y does not contact the image formation area. In a particular example, timing corresponding to an outside of an image formation area may refer to a predetermined amount of time before a time at which the photosensitive drum 51Y stops contacting the image formation area. The predetermined amount of time may be, for example, an amount of time required for a point on the photosensitive drum 51Y to rotate from a contact position where the point on the photosensitive drum 51Y contacts toner on the second developing roller 53Y to a transfer position where the point on the photosensitive drum 51Y contacts an image formation area and a toner image on the photosensitive drum 51Y is transferred onto the sheet S positioned in the image formation area. The same may apply for the second developing rollers 53M and 53C.

In the first embodiment, as the amount of the temporary rotation of the second developing rollers 53Y, 53M and 53C is smaller than a single complete rotation (e.g., a point on the roller starts at a position and rotates back to that same position in the single complete rotation), deterioration of toner can be minimized.

In the first embodiment, the controller 100 widens/increases an interval (e.g., distance and /or time) between the sheets S only when switching the state of the second developing rollers 53Y, 53M and 53C. When there is no need to switch the state of the second developing rollers 53Y, 53M and 53C, the interval between the sheets S can be shortened such that printing speed increases.

As the second developing rollers 53Y, 53M and 53C are driven by the second drive source 220, the color printer 1 can simplify the driving mechanism compared with a case where drive sources are provided for each of the second developing rollers 53Y, 53M and 53C.

In the first embodiment, the second developing rollers 53Y, 53M and 53C are brought to the first state or stopped state at a timing corresponding to an inside of the image formation area. Thus, deterioration of toner can be minimized The "timing corresponding to the inside of the image formation area" may refer to a predetermined amount of time before a time at which a point on the photosensitive drum (e.g., drum 51Y) contacting the second developing roller (e.g., roller 53Y) is to contact an image formation area. The predetermined amount of time may be, for example, an amount of time required for the point on the photosensitive drum to rotate from the contact position where the point on the photosensitive drum contacts toner on the second developing roller (e.g., roller 53Y) to a transfer position where the point on the photosensitive drum contacts an image formation area and a toner image on the photosensitive drum is transferred onto the sheet S positioned in the image formation area.

The first embodiment shows, but the disclosure is not limited to, the temporary rotation of the second developing rollers 53Y, 53M and 53C described above. Additionally or alternatively, the controller 100 may perform the temporary rotation of the second developing rollers 53Y, 53M and 53C at a different timing from that described with reference to FIGS. 2A and 2B.

Figure 3:
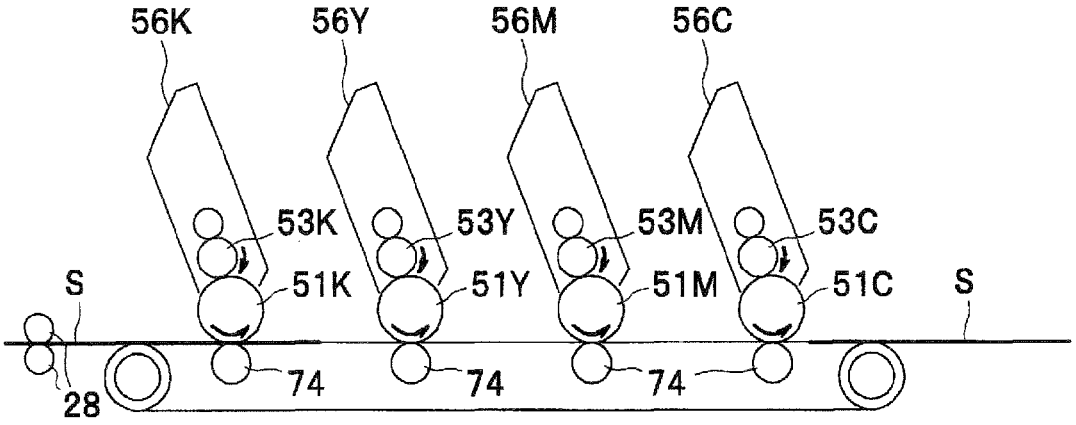
FIG. 3 illustrates the example second developing rollers in the second state (rotating state) according to a second embodiment of the disclosure.

For example, in a second embodiment illustrated in FIG. 3, the interval between sheets S being continuously and/or consecutively fed of when the controller 100 performs the temporary rotation of the second developing rollers 53Y, 53M and 53C is slightly shorter than that shown in the first embodiment. Specifically, as illustrated in FIG. 3, the sheets S are fed at such a short interval that the first photosensitive drum 51K contacts the sheet S and the second photosensitive drums 51Y, 51M, and 51C do not contact the sheet S. The temporary rotation of the second developing rollers 53Y, 53M and 53C is performed in this interval at a timing when contact points where the second developing rollers 53Y, 53M and 53C contact the second photosensitive drums 51Y, 51M and 51C correspond to the outside the image formation area (e.g., the interval between the timing corresponding to a rear end of a first image formation area and a timing corresponding to a front end of a second image formation area immediately subsequent to the first image formation area). Thus, when the sheet sensor 29 detects the trailing end of the sheet S as described in the first embodiment, the controller 100 does not cause the second developing rollers 53Y, 53M and 53C to temporarily rotate nor start to feed a following sheet S. In the second embodiment, the controller 100 is configured to cause the second developing rollers 53Y, 53M and 53C to temporarily rotate at a specified timing with reference to a time T1 at which the registration rollers 28 supply a sheet S to the belt 73.

An example timing will be described with reference to FIG. 4.

Figure 4:
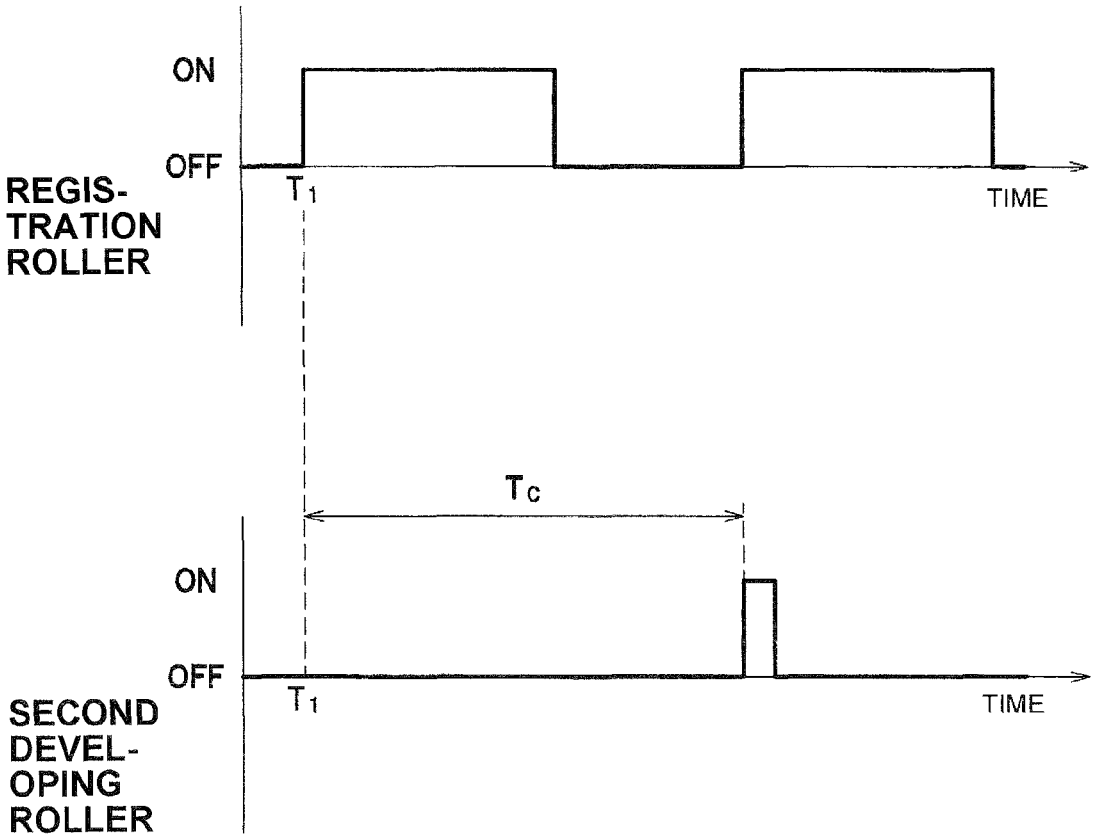
FIG. 4 is an example timing chart illustrating timing for rotating registration rollers and the second developing rollers according to the second embodiment of the disclosure.

As shown in FIG. 4, a time T1 at which the registration rollers 28 starts to rotate to supply a sheet S is used as a reference point. When a predetermined set time Tc has passed from (or elapsed since) time T1, the controller 100 controls the second drive source 220 to cause the second developing rollers 53Y, 53M and 53C to temporarily rotate. The time Tc is set by adding a time required for the registration rollers 28 to feed one sheet S, a time required for the registration rollers 28 to bring, for example, a leading end of the sheet S, from the position of the registration rollers 28 to the second photosensitive drum 51C for cyan, and a time of a slight margin together. When the second developing rollers 53Y, 53M and 53C are temporarily rotated under this control, a similar effect as that achieved from the first embodiment will be obtained. As is apparent from the above description, a set value for the time Tc changes according to a size of the sheet S indicated with a print instruction.

Figure 5A:
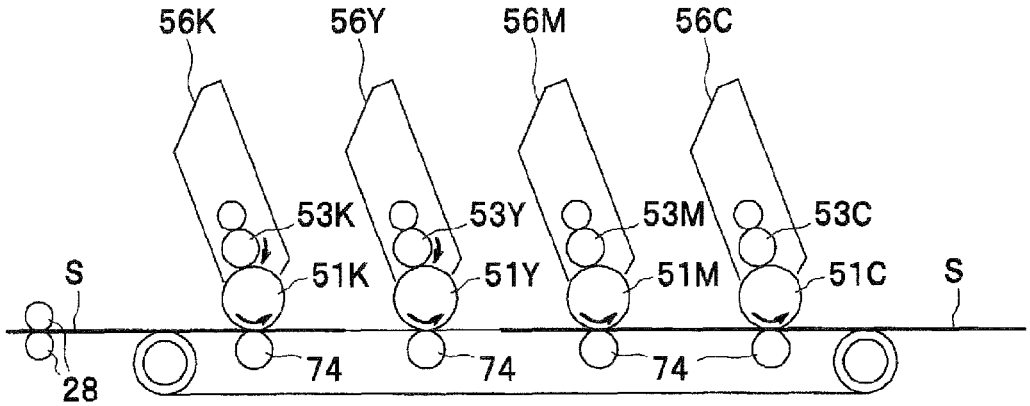
FIG. 5A illustrates a developing roller for the color yellow in a second state (e.g., a rotating state) according to a third embodiment of the disclosure.
Figure 5B:
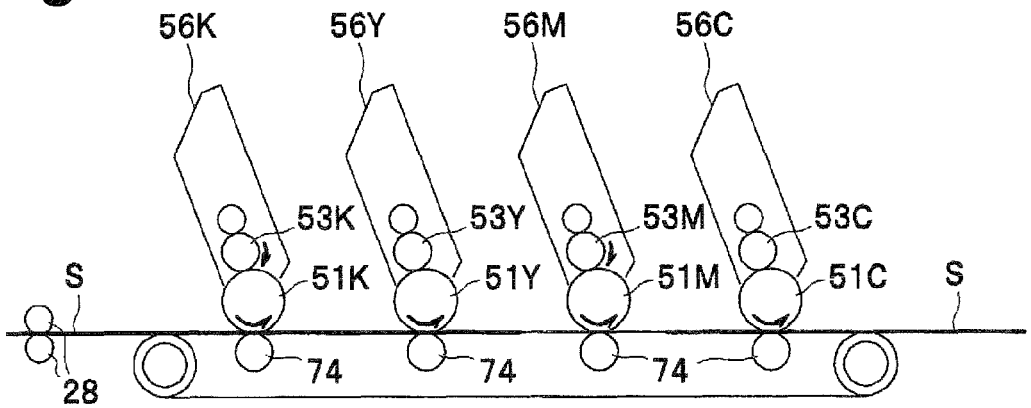
FIG. 5B illustrates a developing roller for the color magenta in the second state (rotating state) according to the third embodiment of the disclosure.
Figure 5C:
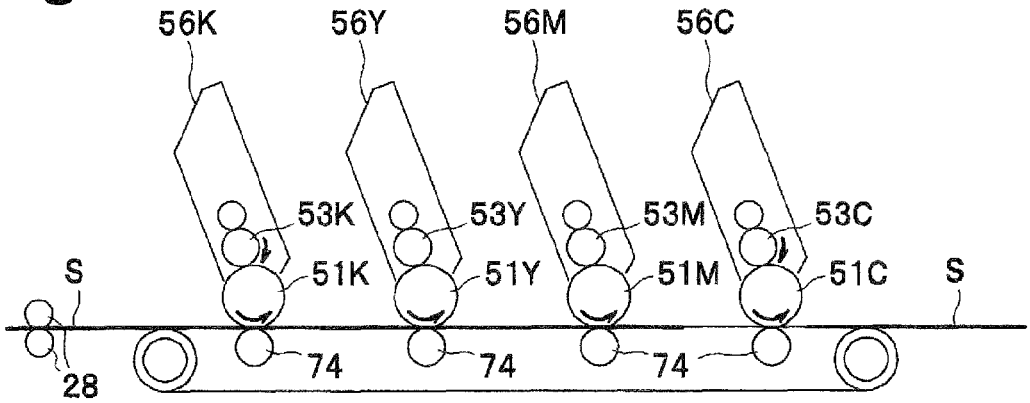
FIG. 5C illustrates a developing roller for the color cyan in the second state (rotating state) according to the third embodiment of the disclosure.

In a third embodiment shown in FIGS. 5A-5C, the interval between sheets S being continuously and/or consecutively fed (e.g., the interval during which the controller 100 performs the temporary rotation of the second developing rollers 53Y, 53M and 53C) is shorter than that in the second embodiment shown in FIG. 3. Specifically, as shown in FIGS. 5A-5C, the sheets S are fed at such a short interval that only one of the second photosensitive drums 51Y, 51M and 51C does not contact a sheet S and the first photosensitive drum 51K and the others of the second photosensitive drums 51Y, 51M and 51C contact sheets S (e.g., at a particular time). Each of the second developing rollers 53Y, 53M and 53C is temporarily rotated in this short interval, at the timing when a corresponding one of the contact points where the second developing rollers 53Y, 53M and 53C contact the second photosensitive drums 51Y, 51M and 51C corresponds to the outside of the image formation area (e.g., an interval between a timing corresponding to a rear end of a first image formation area and a timing corresponding to a front end of a second image formation area immediately subsequent to the first image formation area).

Figure 6:
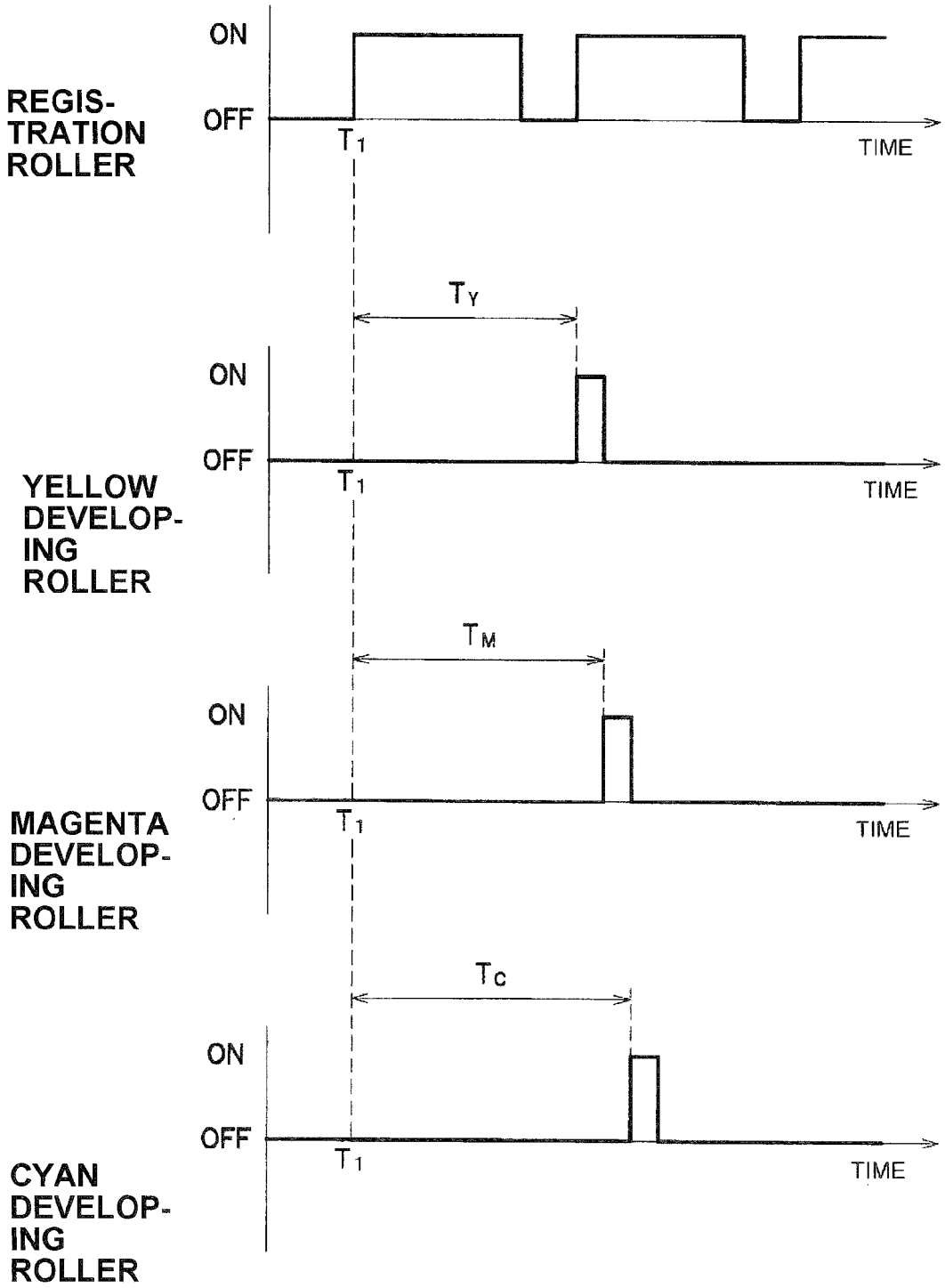
FIG. 6 is an example timing chart illustrating timing for rotating the registration rollers and the second developing rollers according to the third embodiment of the disclosure.

Thus, in the third embodiment, the color laser printer 1 includes second drive sources, which are not shown, and are provided in the same number as the second developing rollers 53Y, 53M and 53C, and the controller 100 controls the second drive sources to drive the second developing rollers 53Y, 53M, and 53C individually. As shown in FIG. 6, a time T1 at which the registration rollers 28 start to supply a sheet S is used as a reference point. The controller 100 controls the second drive sources individually such that, the second developing roller 53Y for yellow is temporarily rotated after a time TY has passed from the time T1, the second developing roller 53M for magenta is temporarily rotated after a time TM has passed from the time T1, and the second developing roller 53C for cyan is temporarily rotated after a time TC has passed from the time T1.

The time TY is set by adding a time required for the registration rollers 28 to feed one sheet S, a time required for the registration rollers 28 to bring, for example, a leading end of the sheet S from the position of the registration rollers 28 to the second photosensitive drum 51Y for yellow corresponding to the second developing roller 53Y for yellow, and a time of a slight margin together. The time TM and the time TC are set in a similar way to the time TY.

With this structure, the interval between sheets S can be shortened substantially, and each of the second developing rollers 53Y, 53M and 53C can be switched from the stopped state to the rotating state and from the rotating state to the stopped state in the shorted interval at the timing when a corresponding one of the contact points where the second developing rollers 53Y, 53M and 53C contact the second photosensitive drums 51Y, 51M and 51C corresponds to the outside of the image formation area. Thus, faster printing speed can be achieved by shortening the interval between the sheets S.

When the second drive sources are assigned to the second developing rollers 53Y, 53M and 53C in a one-to-one relationship, there might not be a need to change the interval between sheets S and at which temporary rotation of the second developing rollers 53Y, 53M and 53C is performed. For example, a usual interval between sheets S (corresponding to a quarter of the length of the upper flat surface of the belt 73) may be maintained. In this case, it may be easier to control the interval between the sheets S.

The illustrative embodiments show, but the disclosure is not limited to, that temporary rotation or stoppage of the second developing rollers 53Y, 53M and 53C is performed during a time from after a sheet S passes the sheet sensor 29 to before a next sheet S is fed by the registration rollers 28. Printing may be performed between a switchover from the stopped state to the rotating state and a switchover from the rotating state to the stopped state.

In this case, after switching the state of the second developing rollers 53Y, 53M and 53C from the stopped state to the rotating state, the controller 100 may control the registration rollers 28 to re-start feeding of sheets S while maintaining the second developing rollers 53Y, 53M and 53C in the rotating state, such that one or more sheets S are printed. After a specified number of sheets S are printed, the controller 100 may switch the state of the second developing rollers 53Y, 53M and 53C from the rotating state to the stopped state at a timing when the contact points where the second developing rollers 53Y, 53M and 53C contact the second photosensitive drums 51Y, 51M and 51C correspond to the outside of the image formation area.

The illustrative embodiments show, but the disclosure is not limited to, a sheet S used as a transfer medium. The transfer medium may be an intermediate transfer belt. In an image forming apparatus using the intermediate transfer belt, toner images on the photosensitive drums are sequentially transferred and overlaid one on top of another, and then transferred from the intermediate transfer belt to a sheet S.

Figure 2A:
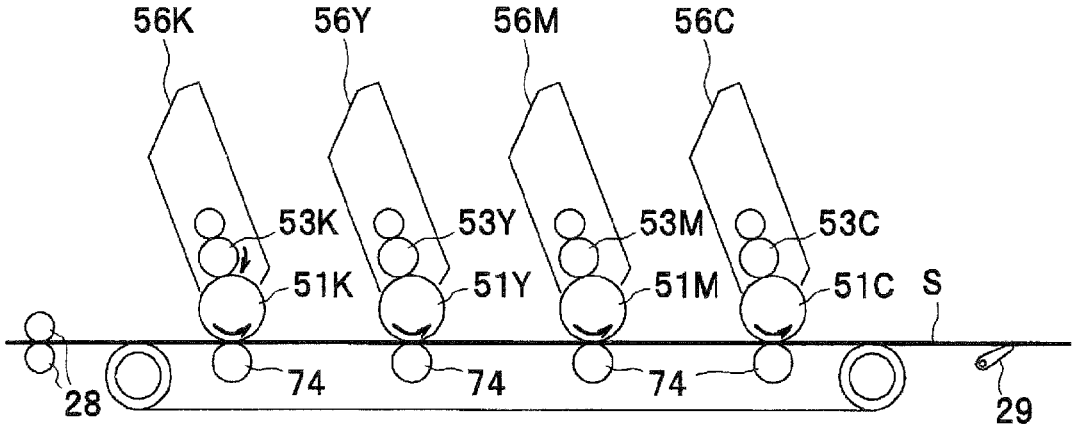
FIG. 2A illustrates example second developing rollers in a first state (stopped state) according to the first embodiment of the disclosure.
Figure 2B:
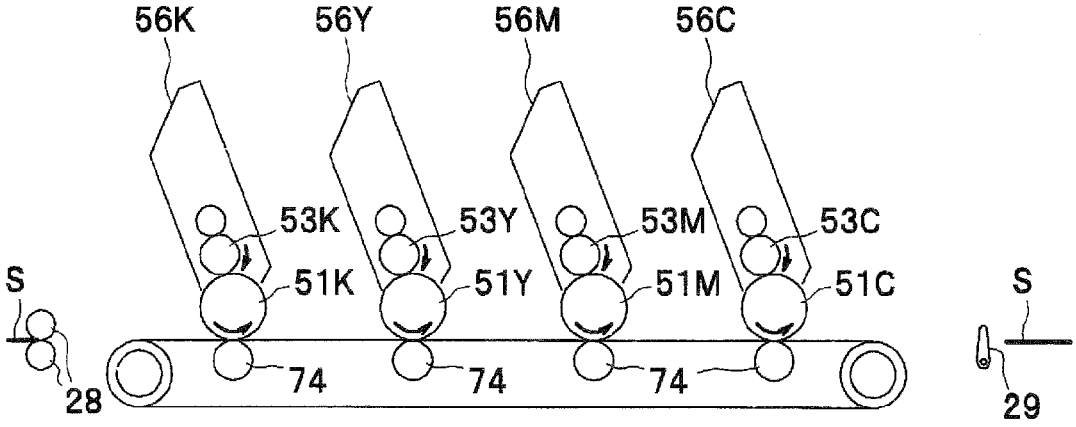
FIG. 2B illustrates the example second developing rollers in a second state (rotating state) according to the first embodiment of the disclosure.

When the intermediate transfer belt is used, as an example of the transfer medium, as in the case of the embodiment shown in FIGS. 2A and 2B, the controller 100 can switch the state of the second developing rollers 53Y, 53M and 53C from the stopped state to the rotating state and from the rotating state to the stopped state at a timing when all of the contact points where the first and second developing rollers 53K, 53Y, 53M and 53C contact the first and second photosensitive drums 51K, 51Y, 51M and 51C correspond to an outside of an image formation area on the intermediate transfer belt. The image formation area on the intermediate transfer belt corresponds to a timing at which an image is transferred from the intermediate transfer belt to the image formation area on a recording sheet.

As in the case of the embodiment shown in FIG. 3, the controller 100 may rotate or stop the second developing rollers 53Y, 53M and 53C (may change their state from the stopped state to the rotating state and from the rotating state to the stopped state) at a timing when contact points where the second developing rollers 53Y, 53M and 53C contact the second photosensitive drums 51Y, 51M and 51C correspond to the outside of the image formation area on the intermediate transfer belt.

As in the case of the embodiment shown in FIGS. 5A-5C, the controller 100 may perform a switchover of the state of each of the second developing rollers 53Y, 53M and 53C from the stopped state to the rotating state and a switchover from the rotating state to the stopped state at a timing when a corresponding one of contact points where the second developing rollers 53Y, 53M, and 53C contact the second photosensitive drums 51Y, 51M and 51C corresponds to the outside of the image formation area on the intermediate transfer belt.

The illustrative embodiments show, but the disclosure is not limited to, that, when the number of sheets S printed continuously and/or consecutively exceeds the specified value, the state of the second developing rollers 53Y, 53M and 53C is switched. The state of the second developing rollers 53Y, 53M and 53C may be switched every time a sheet S is printed. In other words, the state of the second developing rollers 53Y, 53M and 53C may be switched between sheets S or after some sheets S are printed. In terms of the first embodiment described with reference to FIG. 2, the state of the second developing rollers 53Y, 53M and 53C may be switched at the timing when the contact points where the second developing rollers 53Y, 53M and 53C contact the second photosensitive drums 51Y, 51M and 51C correspond to the outside of the image formation area on the transfer medium (e.g., when a contact point between the first developing roller and the photosensitive drum corresponds to a point on the photosensitive drum configured to contact a non-image formation area). In terms of the second embodiment described with reference to FIG. 3, the state of the second developing rollers 53Y, 53M and 53C may be switched at the timing when the contact points where the second developing rollers 53Y, 53M and 53C contact the second photosensitive drums 51Y, 51M and 51C correspond to the outside of the image formation area on the transfer medium.

The state of the second developing rollers 53Y, 53M and 53C may be switched at a timing corresponding to a specified time elapsing from the start of continuous printing.

The illustrative embodiments show, but the disclosure is not limited to the LED units 40 as an exposure device disposed facing the photosensitive drum 51 between the developing roller 53 and the scorotron charger 52. The exposure device disposed facing the photosensitive drum between a developer carrier and a charger may include a laser scanner provided in association with each photosensitive drum and configured to expose the surface of the photosensitive drum by scanning a laser beam at high speed on the surface of the photosensitive drum after being charged.

The illustrative embodiments show, but the disclosure is not limited to, application of the aspects described herein to the color printer as an image forming apparatus. For example, one or more aspects described herein may be applied to other apparatuses, e.g., a multifunction apparatus and a copying apparatus.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. An image forming apparatus, comprising:

a first photosensitive member corresponding to a first developer;

a second photosensitive member corresponding to a second developer;

a first exposure device configured to expose the first photosensitive member;

a second exposure device configured to expose the second photosensitive member;

an endless belt disposed such that the endless belt contacts the first photosensitive member and the second photosensitive member;

a first developing roller configured to rotate and supply the first developer to a first contact position where the first photosensitive member contacts the first developer;

a second developing roller configured to rotate and supply the second developer to a second contact position where the second photosensitive member contacts the second developer; and a controller configured to:

cause a first switch of the second developing roller, during a continuous rotation of the first developing roller, from a first state where the second developing roller stops with the second photosensitive member contacting the second developer to a second state where the second developing roller rotates with the second photosensitive member contacting the second developer, and cause a second switch of the second developing roller, during the continuous rotation of the first developing roller, from the second state to the first state, such that both of the first switch and the second switch occur in a period between a timing corresponding to a rear end of a first image formation area and a timing corresponding to a front end of a second image formation area immediately subsequent to the first image formation area, and such that the second developing roller rotates less than 360° in the second state.

2. The image forming apparatus according to claim 1, wherein, at at least one point in time during the first state, at least a portion of the second developing roller directly contacts the second photosensitive member.

3. The image forming apparatus according to claim 1, wherein the controller is configured to cause the second switch, at a timing corresponding to an inside of the image formation area.

4. The image forming apparatus according to claim 1, wherein the controller is configured to increase an interval between the first image formation area and the second image formation area immediately subsequent to the first image formation area when the controller causes one of the first switch and the second switch to be greater than an interval between the first image formation area and the second image formation area when the controller does not cause the first switch and the second switch.

5. The image forming apparatus according to claim 1, wherein the controller is configured to cause at least one of the first switch and the second switch, at a timing corresponding to an interval between two recording sheets being consecutively fed.

6. The image forming apparatus according to claim 1, wherein the controller is configured to cause both of the first switch and the second switch, at a timing corresponding to an interval between two recording sheets being consecutively fed.

7. The image forming apparatus according to claim 5, wherein the controller is configured to cause the second switch, at a timing corresponding to an inside of an image formation area on a recording sheet.

8. The image forming apparatus according to claim 5, wherein the controller is configured to increase an interval between two recording sheets being consecutively fed when the controller causes one of the first switch and the second switch to be greater than an interval between the two recording sheets being consecutively fed when the controller does not cause the first switch and the second switch.

9. The image forming apparatus according to claim 1, further comprising:

a third photosensitive member corresponding to a third developer;

a fourth photosensitive member corresponding to a fourth developer;

a third developing roller configured to rotate and supply the third developer to a third contact position where the third photosensitive member contacts the third developer;

a fourth developing roller configured to rotate and supply the fourth developer to a fourth contact position where the fourth photosensitive member contacts the fourth developer; and a drive source configured to drive the second, third and fourth developing rollers.

10. The image forming apparatus according to claim 1, wherein the image forming apparatus is configured to transfer images formed on the first and second photosensitive members to a recording sheet.

11. The image forming apparatus according to claim 1, wherein the second photosensitive member rotates when the second developing roller is in the first state.

12. The image forming apparatus according to claim 11, wherein the second photosensitive member rotates when the second developing roller is in the second state.

13. The image forming apparatus according to claim 1, further comprising a registration roller configured to feed a transfer medium toward the first photosensitive drum, wherein the controller is configured to control the registration roller to start feeding of a subsequent transfer medium after the second state terminates.

14. The image forming apparatus according to claim 1, further comprising a sensor for detecting a transfer medium on which an image is formed, wherein the controller is configured to cause the first switch after a trailing end of the transfer medium passes through the sensor.

15. An image forming apparatus comprising:

a photosensitive member corresponding to a developer;

an exposure device configured to expose the photosensitive member;

an endless belt disposed such that the endless belt contacts the photosensitive member;

a developing roller configured to rotate and supply the developer to a contact position where the photosensitive member contacts the developer; and a controller configured to:

cause a first switch of the developing roller from a first state where the developing roller stops with the photosensitive member contacting the developer to a second state where the developing roller rotates with the photosensitive member contacting the developer, and cause a second switch of the developing roller from the second state to the first state, such that both of the first switch and the second switch occur in a period between a timing corresponding to a rear end of a first image formation area and a timing corresponding to a front end of a second image formation area immediately subsequent to the first image formation area, and such that the developing roller rotates less than 360° in the second state.

16. The image forming apparatus of claim 15, wherein the controller is configured to cause the first and second switches during a continuous rotation of another developing roller of the image forming apparatus.

17. The image forming apparatus of claim 16, wherein the other developing roller corresponds to a developer used for monochrome printing and wherein the developing roller caused to switch corresponds to a developer not used for monochrome printing.

* * * * *